US009805894B2

(12) United States Patent
Manthey

(10) Patent No.: US 9,805,894 B2
(45) Date of Patent: Oct. 31, 2017

(54) CONNECTING APPARATUS AND ELECTRICAL SWITCH

(71) Applicant: Siemens Aktiengesellschaft, Munich (DE)

(72) Inventor: Katja Manthey, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/246,630

(22) Filed: Aug. 25, 2016

(65) Prior Publication Data

US 2017/0098519 A1 Apr. 6, 2017

(30) Foreign Application Priority Data

Oct. 2, 2015 (DE) ..... 10 2015 219 119

(51) Int. Cl.
*H01H 71/02* (2006.01)

(52) U.S. Cl.
CPC .... *H01H 71/0214* (2013.01); *H01H 71/0264* (2013.01); *H01H 2071/0242* (2013.01)

(58) Field of Classification Search
CPC ..... H01H 71/0214; H01H 71/0242; H01H 71/0228; H01H 71/025; H01H 71/0235; H01H 71/0264–71/0285; H01R 13/518; H01R 9/2608; H01R 9/26
USPC ..... 200/293, 295; 335/6, 8–10, 202; 439/716, 532
See application file for complete search history.

(56) References Cited

U.S. PATENT DOCUMENTS 3,160,280 A * 12/1964 Burch ..... H02B 1/052 211/26
3,576,520 A * 4/1971 Stauffer ..... H01R 9/26 257/724
4,090,764 A * 5/1978 Malsby ..... H01R 13/514 439/471
4,988,553 A * 1/1991 Saiki ..... H02G 3/18 200/293
6,004,162 A * 12/1999 Harting ..... H01R 13/518 439/532
6,142,835 A * 11/2000 Daoud ..... H04Q 1/028 439/532
6,176,735 B1 * 1/2001 Kawaguchi ..... B60R 16/0238 439/298

(Continued)

*Primary Examiner* — Gary Paumen
(74) *Attorney, Agent, or Firm* — Harness, Dickey & Pierce, P.L.C.

(57) ABSTRACT

A connecting apparatus is for connecting a first component to a second component in an interlocking manner. The first component includes a flexible limb having a latching lug which can latch with a projection on the second component in order to connect the first component to the second component in a releasable manner without using a tool. For the purpose of connection in a releasable manner without using a tool, the flexible limb runs in a guide of the second component, which guide allows the flexible limb only to move in the direction which is prespecified by the guide, and the latching lug and the projection are at a distance from one another in the state in which said components are connected in an interlocking manner. An electrical switch is also disclosed, including the connecting apparatus; a side wall; and a pole cassette.

20 Claims, 6 Drawing Sheets

(56) References Cited

U.S. PATENT DOCUMENTS

| | | | | |
|---|---|---|---|---|
| 6,196,869 | B1 * | 3/2001 | Kay | H01R 9/2441<br>439/532 |
| 7,316,591 | B2 * | 1/2008 | Ferderer | H01R 13/518<br>439/532 |
| 7,597,578 | B2 * | 10/2009 | Adunka | H02B 1/056<br>200/295 |
| 2006/0025010 | A1 * | 2/2006 | Spitaels | H01R 13/741<br>439/532 |
| 2016/0012983 | A1 * | 1/2016 | Wu | H01H 13/04<br>200/295 |

* cited by examiner

CONNECTING APPARATUS AND ELECTRICAL SWITCH

PRIORITY STATEMENT

The present application hereby claims priority under 35 U.S.C. §119 to German patent application number DE 102015219119.2 filed Oct. 2, 2015, the entire contents of which are hereby incorporated herein by reference.

FIELD

At least one embodiment of the invention generally relates to a connecting apparatus for connecting a first component to a second component in an interlocking manner, and also generally relates to an electrical switch having a connecting apparatus of this kind.

BACKGROUND

Electrical switches serve to switch electric currents. IEC-certified and UL-certified variants are typically available. Known types of UL-certified switches include those which are installed directly into a so-called panel board. Special UL-certified switches of this kind are also called low-tab switches.

An electrical low-tab switch comprises a pole cassette package, a housing upper part, an accessories cover and a thermomagnetic trip unit (TMTU). A housing lower part for an electrical low-tab switch is not required, or a housing lower part is replaced by the so-called top barrier which is installed in the panel board. A plurality of switches can be installed into the top barrier next to one another, wherein the top barrier ensures insulation between the phases within a switch and between various switches.

Since a housing lower part cannot be installed, it is necessary for both the panel board and the housing upper part to also take on the function of the housing lower part.

A housing upper part typically has to ensure, amongst other things, that the air and creepage paths correspond to the standards, and the rotors of the pole cassette are covered. Therefore, the housing upper part has two side walls which project downward to a great extent. In the event of a short circuit with the creation of an arc with a plasma, these side walls would be bent or even destroyed if they were still additionally fixed.

SUMMARY

At least one embodiment involves a connecting apparatus for low-tab switches, which connecting apparatus ensures that the side walls are not damaged when the switch is tripped.

At least one embodiment of the invention is directed to a connecting apparatus. Advantageous refinements of the connecting apparatus according to embodiments of the invention are specified in the claims. At least one embodiment of the invention is directed to an electrical switch including a connecting apparatus according to at least one embodiment of the invention. Advantageous refinements of the electrical switch according to embodiments of the invention are specified in the claims.

The connecting apparatus according to at least one embodiment of the invention for connecting a first component to a second component in an interlocking manner is designed such that the first component comprises a flexible limb having a latching lug which can latch with a projection on the second component in order to connect the first component to the second component in a releasable manner without using a tool. For the purpose of connection in a releasable manner without using a tool, the flexible limb runs in a guide of the second component, which guide allows the flexible limb only to move in the direction which is prespecified by the guide, and the latching lug and the projection are at a distance from one another in the state in which said components are connected in an interlocking manner.

The apparatus according to at least one embodiment of the invention apparatus, comprises a first component including a flexible limb including a latching lug; and a second component including a guide and a projection, the flexible limb, including the latching lug, being configured to latch with the projection on the second component to connect the first component to the second component in a releasable manner, and the flexible limb being configured to run in the guide of the second component to connect the first component to the second component in a releasable manner without using a tool, the guide allowing the flexible limb only to move in a direction specified by the guide and the latching lug and the projection being at a distance from one another in a state in which the first and second components are connected in an interlocking manner.

The electrical switch according to at least one embodiment of the invention, including a connecting apparatus according to at least one embodiment of the invention, comprises a side wall and a pole cassette, which side wall and pole cassette are connected to one another by way of the connecting apparatus according to the invention. In this case, the flexible limb with the latching lug can be arranged on the side wall, and the projection and the guide can be part of the pole cassette. The side wall can be designed as part of a cover.

The above-described properties, features and advantages of this invention, and also the way in which they are achieved, will become more clearly and easily understandable in connection with the following description of the example embodiments which will be explained in more detail in connection with the figures.

DETAILED DESCRIPTION OF THE EXAMPLE EMBODIMENTS

Figure 1:
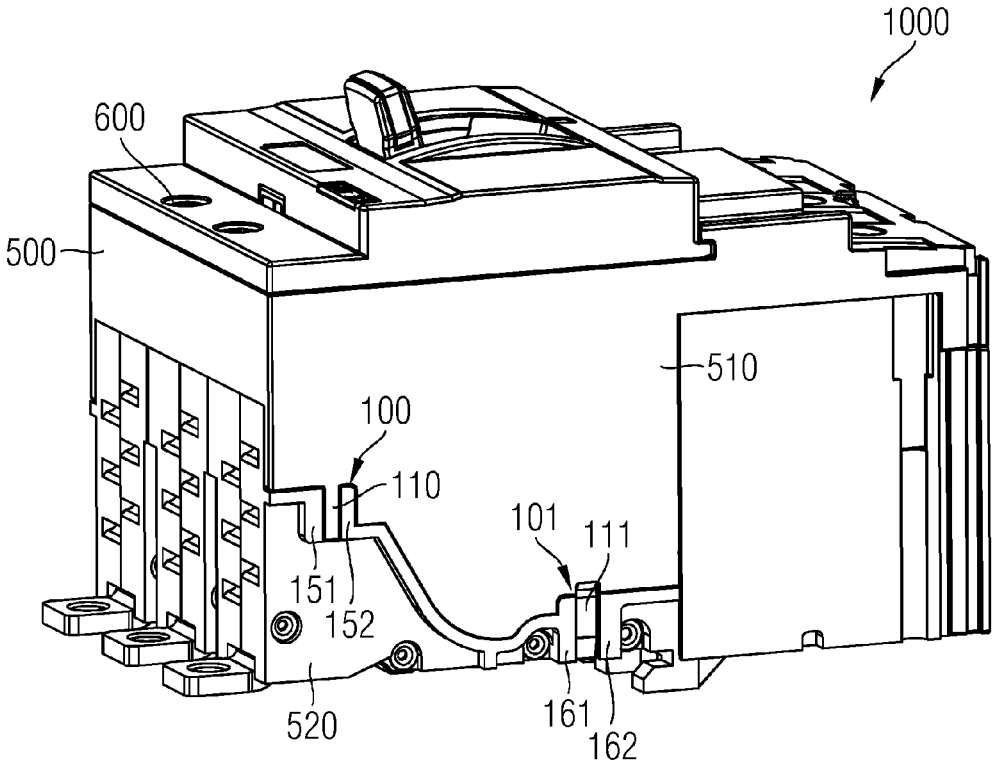
FIG. 1 shows an electrical switch having a side wall and pole cassette, and also the first and the second connecting apparatus.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The connecting apparatus according to at least one embodiment of the invention for connecting a first component to a second component in an interlocking manner is designed such that the first component comprises a flexible limb having a latching lug which can latch with a projection on the second component in order to connect the first component to the second component in a releasable manner without using a tool. For the purpose of connection in a releasable manner without using a tool, the flexible limb runs in a guide of the second component, which guide allows the flexible limb only to move in the direction which is prespecified by the guide, and the latching lug and the projection are at a distance from one another in the state in which said components are connected in an interlocking manner.

It is advantageous in at least one embodiment that the connecting apparatus is not rigid, but rather the first component and the second component can be moved in relation to one another on account of the spacing between the latching lug and the projection. The guide ensures that this movement is possible only in a firmly prespecified direction.

In one embodiment, the latching lug and the projection are at a distance of between 5 mm and 13 mm from one another in the state in which said components are connected in an interlocking manner.

In a further embodiment, the flexible limb and the guide form a dovetail connection.

The electrical switch according to at least one embodiment of the invention, including a connecting apparatus according to at least one embodiment of the invention, comprises a side wall and a pole cassette, which side wall and pole cassette are connected to one another by way of the connecting apparatus according to the invention. In this case, the flexible limb with the latching lug can be arranged on the side wall, and the projection and the guide can be part of the pole cassette. The side wall can be designed as part of a cover.

In one embodiment, the electrical switch additionally comprises a mechanical connection which rigidly connects the cover and the pole cassette. It is advantageous here that the cover is rigidly connected by this mechanical connection but, nevertheless, the side wall is flexible and there is a certain amount of play on account of the connecting apparatus according to at least one embodiment of the invention. This flexibility is advantageous when tripping the electrical switch and forming an arc with a plasma, and with the associated increase in pressure in the electrical switch. The side wall is therefore allowed to bulge instead of rupturing. Furthermore, the flexible limb cannot leave the guide, this being prevented by the latching lug and the projection. Movement of the limb in the guide is possible only until the latching lug and the projection interengage.

In a further embodiment, the electrical switch comprises a further connecting apparatus which likewise connects the side wall and the pole cassette to one another.

The above-described properties, features and advantages of this invention, and also the way in which they are achieved, will become more clearly and easily understandable in connection with the following description of the example embodiments which will be explained in more detail in connection with the figures.

FIG. 1 illustrates an electrical switch 1000. This electrical switch 1000 comprises a cover 500, wherein a side wall 510 is part of the cover 500. The switch 1000 additionally comprises a pole cassette 520. The side wall 510 covers the pole cassette 520 at the side.

Figure 6:
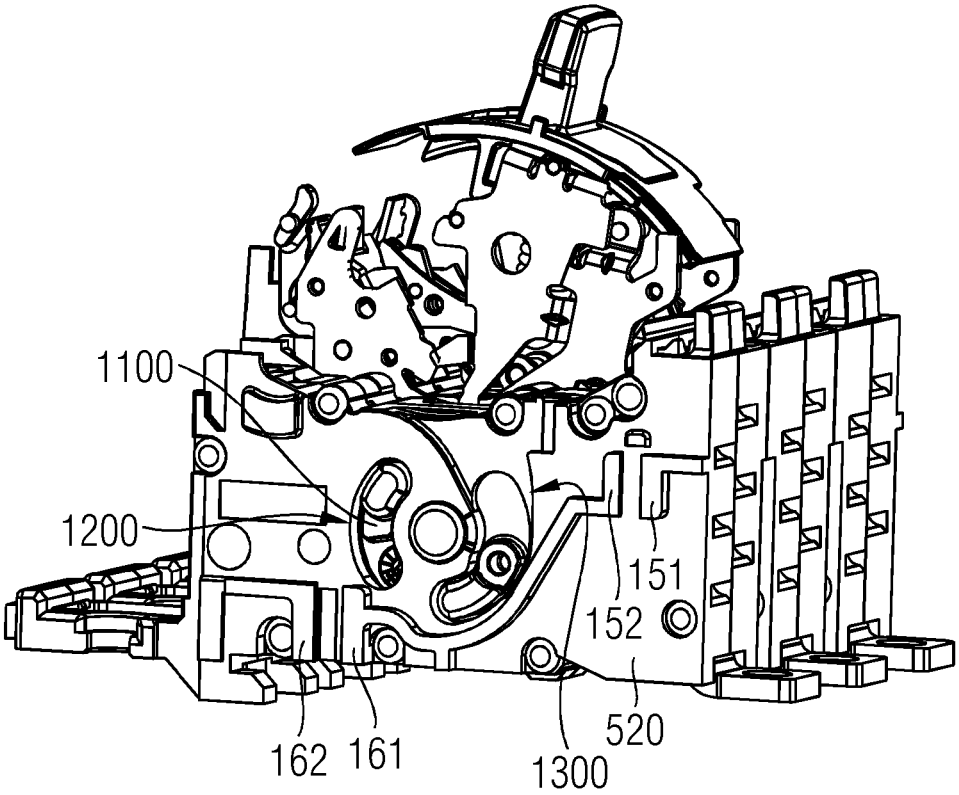
FIG. 6 shows pole cassettes with openings on the rotor.

The pole cassette 520 is illustrated in greater detail in FIG. 6 which shows the pole cassette 520 with its rotor 1100. The pole cassette has openings 1200, 1300 through which rotors 1100 of adjacent pole cassettes can be connected, for example, to connecting elements. The side wall 510 covers these openings 1200, 1300. In the event of an arc with plasma being produced within the pole cassette 520, there is an increase in pressure within the pole cassette and therefore gases flow out through the openings 1200, 1300 of the pole cassette 520. This pressure is transferred to the side wall 510 which is connected to the pole cassette 520 via connecting apparatuses 100; 101 according to an embodiment of the invention.

According to FIG. 1, the side wall 510 comprises a flexible limb 110 having a latching lug 120 for this purpose. A guide 151, 152 which is designed in a complementary manner to the flexible limb 110 and can receive said flexible limb is attached to the pole cassette 520. In FIG. 1, the cover 500 or the side wall 510 is illustrated in a manner connected to the pole cassette 520 in an interlocking manner. This means that the flexible limb 110 runs in the guide 151, 152 of the pole cassette 520 for the purpose of connection in a releasable manner without using a tool. The guide 151, 152 allows the flexible limb 110 only to move in the direction which is prespecified by the guide 151, 152. In accordance with FIG. 1, this means that the limb 110 and therefore the side wall 510 can only be moved upward.

The electrical switch 1000 of FIG. 1 furthermore comprises a second connecting apparatus 101 which is similar to the first connecting apparatus 100. To this end, the second connecting apparatus 101 comprises a flexible limb 111 with a latching lug 121 on the side wall 510, and also a guide 161, 162 on the pole cassette 520.

Figure 2:
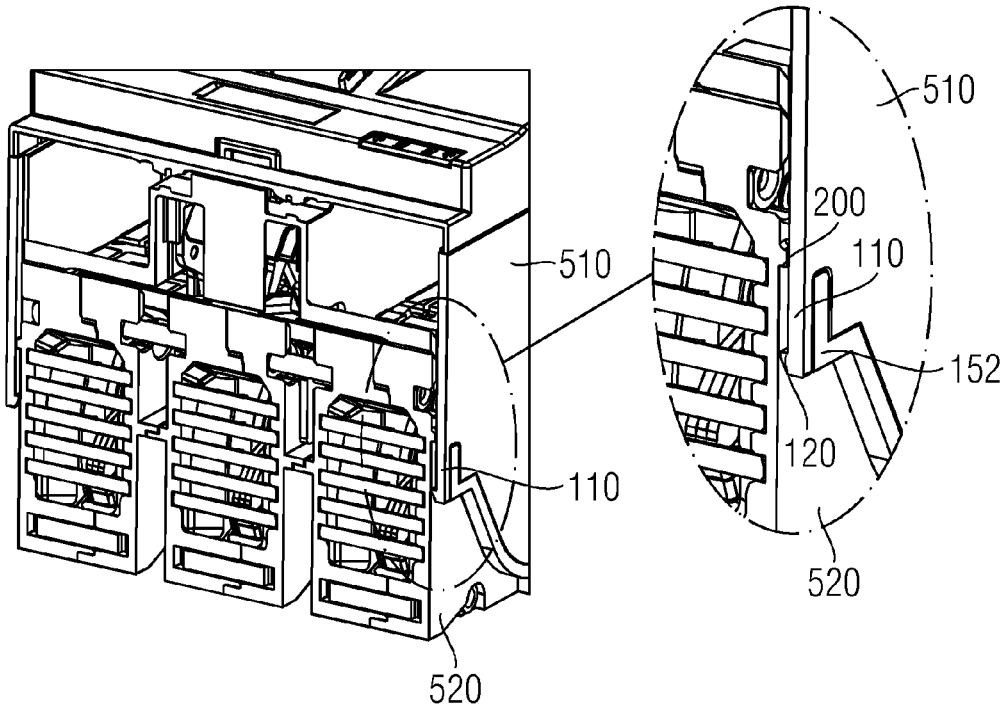
FIG. 2 shows a detailed view of the electrical switch with the first connecting apparatus.

FIG. 2 illustrates the first connecting apparatus 100 in greater detail. Said figure shows the projection 200 on the pole cassette 520, it being possible for the latching lug 120 of the flexible limb 110 to latch on said projection. The latching lug 120 and the projection 200 are arranged at a distance from one another in the state in which said components are connected in an interlocking manner. In accordance with FIG. 2, this means that there is a vertical distance between the latching lug 120 and the projection 200. This means that this cover 500 could be raised in line with the length of the spacing if there is no further connection between cover 500 and pole cassettes 520.

The latching lug 120 and the projection 200 are at a distance of between 5 mm and 13 mm in the state in which the components are connected in an interlocking manner. The distance between the latching lug 120 and the projection 200 can be 9 mm for example.

The electrical switch 100 additionally comprises a mechanical connection 600 which rigidly connects the cover 500 and the pole cassette 520. In accordance with FIG. 1, this additional mechanical connection 600 can be, for example, a screw connection, but other types of connection, such as latching connections, are likewise feasible. The additional mechanical connection 600 ensures that the cover 500 remains in its position on the switch 1000, even in the event of an overpressure being produced in the switch 1000 and the side wall 510 bulging. In a case such as this, the latching lug 120 can move toward the projection 200 and there is no risk of the side wall 510 bursting. The stop on the projection 200 means that the connecting apparatus 100 also cannot become detached in a case such as this, and at most the latching lug 120 can move as far as the projection 200.

Figure 3:
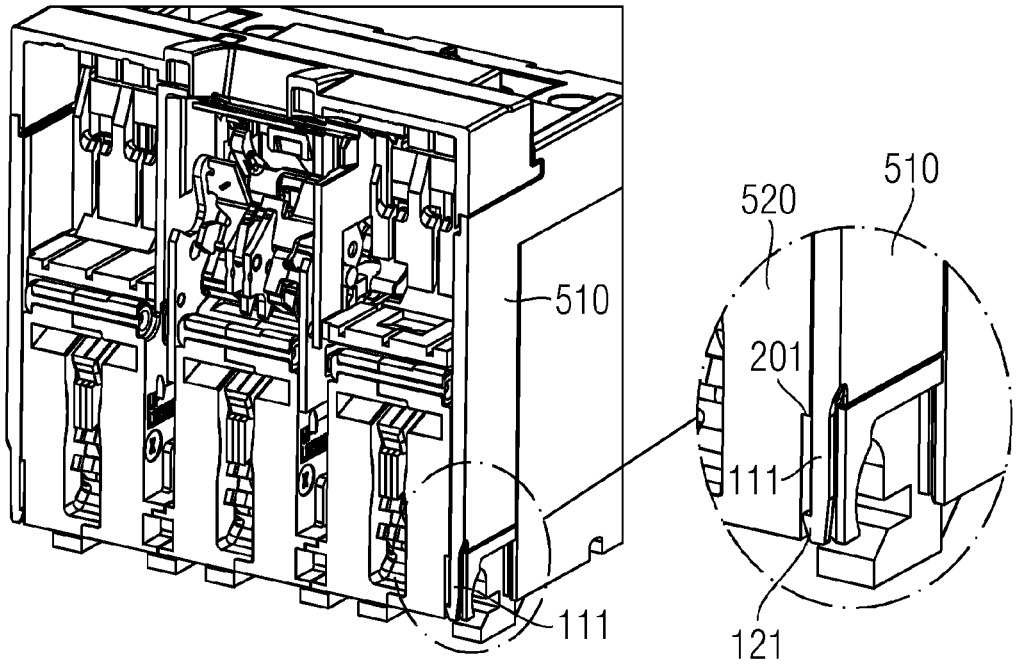
FIG. 3 shows a detailed view of the electrical switch with the second connecting apparatus.

FIG. 3 illustrates the second connecting apparatus 101 in greater detail. A flexible limb 111 is provided with a latching lug 121 in this second connecting apparatus 101 too. The flexible limb 111 and the latching lug 121 are part of the side wall 510. The pole cassette 520 comprises a projection 201 which interacts with the latching lug 121. In addition, the second connecting apparatus 101 comprises a guide 161, 162 in which the flexible limb 111 runs.

Figure 4:
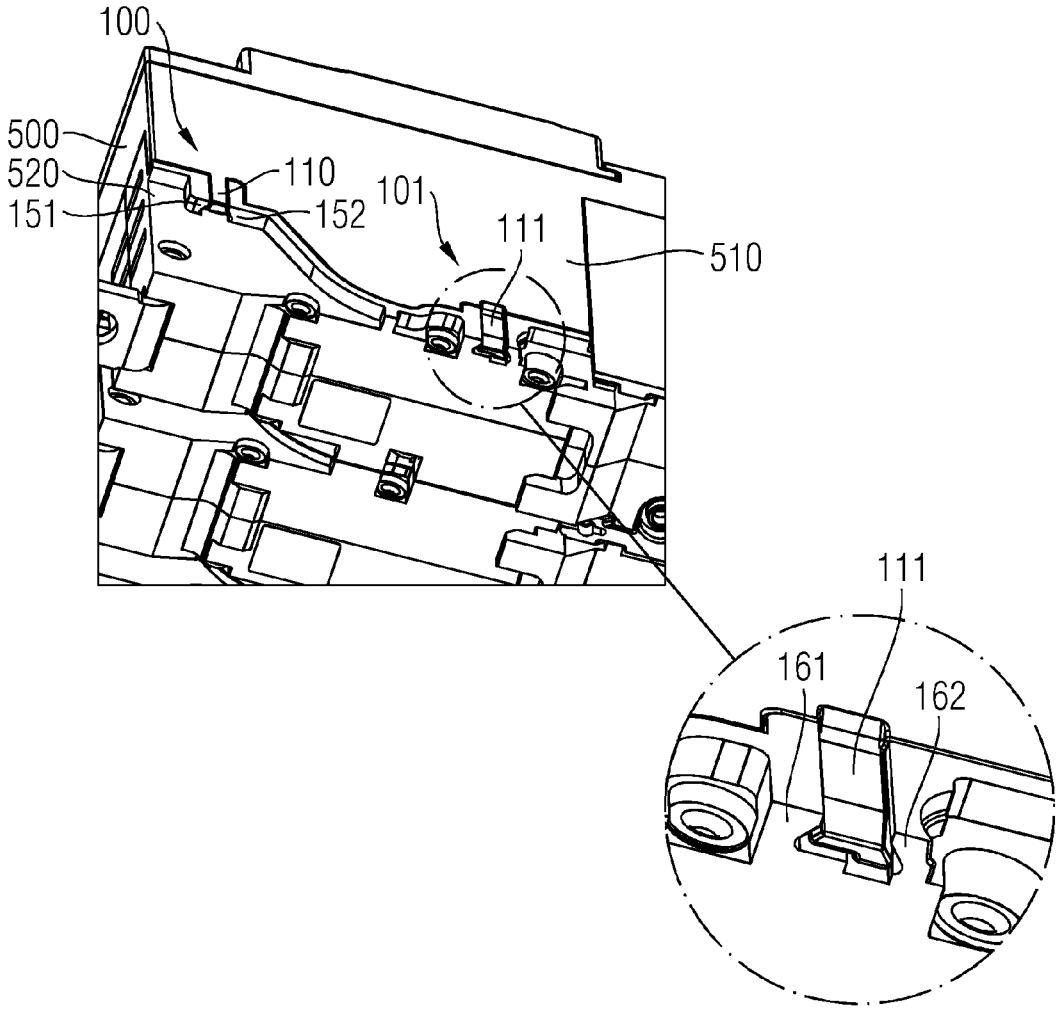
FIG. 4 shows the electrical switch and a detailed view of the dovetail connection.

FIG. 4 illustrates that the flexible limb 111 and the guide 161, 162 form a dovetail connection. However, other types of connection are likewise feasible; the guide 161, 162 only has to guarantee that the flexible limb 111 can move only in one direction in the guide 161, 162.

Figure 5:
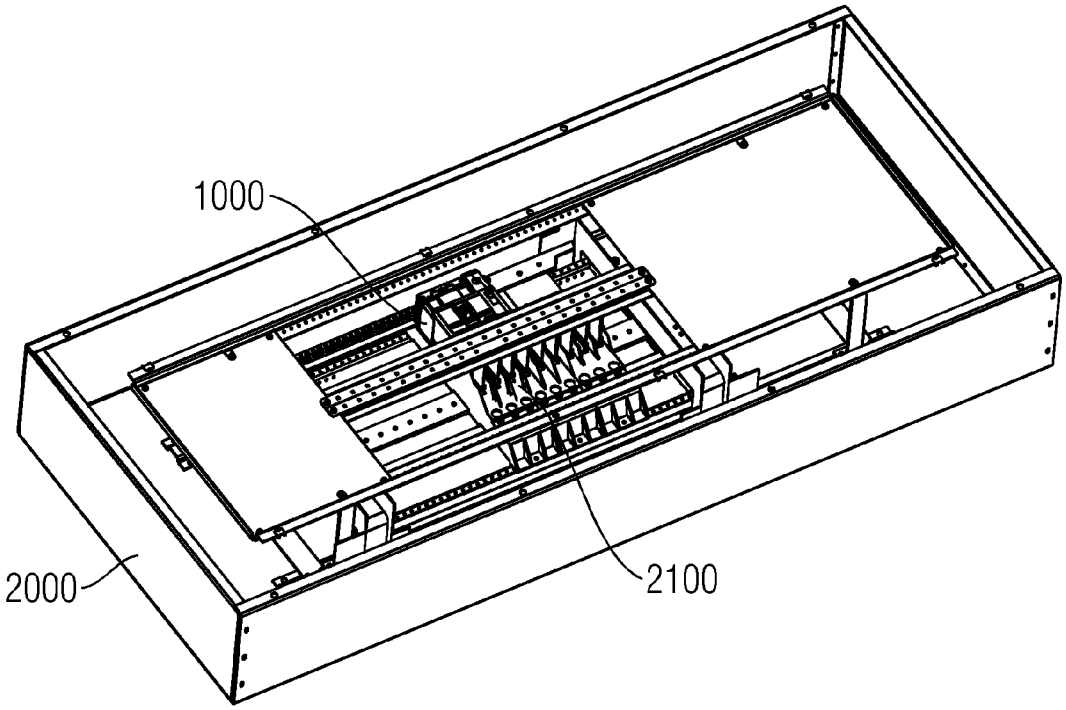
FIG. 5 shows the panel board for the installation of low-tab switches.

FIG. 5 illustrates a panel board 2000 which can receive the electrical switch 1000. A top barrier 2100 is provided for insulating between the phases of the individual electrical switches 1000 and between the phases within a switch.

The connecting apparatus 100; 101, according to an embodiment of the invention, means that the snap action of the side wall 510 and the pole cassette 520 comes into effect only after a few millimeters, this allowing the side wall 510 to bulge in the event of a short-circuit. This is necessary in order for the pressure which is produced to leave the electrical switch 1000. Since the flexible limbs 110; 111 cannot slip out of the guides 151, 152; 161, 162 owing to the snap action, the correct position of the side wall 510 is ensured after a short circuit.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. §112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A connecting apparatus for connecting a first component to a second component in an interlocking manner, the first component including a flexible limb including a latching lug to latch with a projection on the second component to connect the first component to the second component in a releasable manner without using a tool, wherein, for the purpose of connection in a releasable manner without using a tool, the flexible limb is configured to run in a guide of the second component, the guide allowing the flexible limb only to move in a direction prespecified by the guide, and wherein the latching lug and the projection are at a distance from one another in a state in which the first and second components are connected in an interlocking manner.

2. The connecting apparatus of claim 1, wherein the latching lug and the projection are at a distance of between 5 mm and 13 mm from one another in the state in which the first and second components are connected in an interlocking manner.

3. The connecting apparatus of claim 1, wherein the flexible limb and the guide form a dovetail connection.

4. An electrical switch comprising:

the connecting apparatus of claim 1;

a side wall; and a pole cassette, the side wall and pole cassette being connected to one another via the connecting apparatus.

5. The electrical switch of claim 4, wherein the flexible limb including the latching lug is arranged on the side wall, and wherein the projection and the guide are part of the pole cassette.

6. The electrical switch of claim 5, wherein the side wall is designed as part of a cover.

7. The electrical switch of claim 5, further comprising a mechanical connection to rigidly connect the cover and the pole cassette.

8. The electrical switch of claim 4, further comprising a second connecting apparatus, to further connect the side wall and the pole cassette to one another.

9. The connecting apparatus of claim 2, wherein the flexible limb and the guide form a dovetail connection.

10. The electrical switch of claim 6, wherein the electrical switch additionally comprises a mechanical connection to rigidly connect the cover and the pole cassette.

11. The electrical switch of claim 5, further comprising a second connecting apparatus, to further connect the side wall and the pole cassette to one another.

12. An apparatus, comprising:

a first component including a flexible limb including a latching lug; and a second component including a guide and a projection, the flexible limb, including the latching lug, being configured to latch with the projection on the second component to connect the first component to the second component in a releasable manner, and the flexible limb being configured to run in the guide of the second component to connect the first component to the second component in a releasable manner without using a tool, the guide allowing the flexible limb only to move in a direction specified by the guide and the latching lug and the projection being at a distance from one another in a state in which the first and second components are connected in an interlocking manner.

13. The connecting apparatus of claim 12, wherein the latching lug and the projection are at a distance of between 5 mm and 13 mm from one another in the state in which the first and second components are connected in an interlocking manner.

14. The connecting apparatus of claim 12, wherein the flexible limb and the guide form a dovetail connection.

15. The connecting apparatus of claim 13, wherein the flexible limb and the guide form a dovetail connection.

16. An electrical switch comprising:

the apparatus of claim 12;

a side wall; and a pole cassette, the side wall and pole cassette being connected to one another via the apparatus.

17. The electrical switch of claim 16, wherein the flexible limb including the latching lug is arranged on the side wall, and wherein the projection and the guide are part of the pole cassette.

18. The electrical switch of claim 17, wherein the side wall is designed as part of a cover.

19. The electrical switch of claim 17, further comprising a mechanical connection to rigidly connect the cover and the pole cassette.

20. The electrical switch of claim 16, further comprising a second connecting apparatus, to further connect the side wall and the pole cassette to one another.

* * * * *